US006499611B1

(12) United States Patent
Franzen et al.

(10) Patent No.: US 6,499,611 B1
(45) Date of Patent: Dec. 31, 2002

(54) MOBILE HARBOR CRANE FOR NORMAL AND HEAVY LOAD OPERATION

(75) Inventors: Hermann Franzen, Mönchengladbach (DE); Joachim Kröll, Jüchen (DE)

(73) Assignee: Atecs Mannesmann AG, Düsseldorf (DE)

( * ) Notice: Subject to any disclaimer, the term of this patent is extended or adjusted under 35 U.S.C. 154(b) by 134 days.

(21) Appl. No.: 09/660,152

(22) Filed: Sep. 13, 2000

(30) Foreign Application Priority Data

Sep. 13, 1999 (DE) ..... 199 44 927

(51) Int. Cl.[7] ..... B66C 23/76
(52) U.S. Cl. ..... 212/196; 212/198
(58) Field of Search ..... 212/196, 197, 212/298, 238, 261, 195, 198, 256

(56) References Cited

U.S. PATENT DOCUMENTS

| | | | | |
|---|---|---|---|---|
| 3,092,260 A | * | 6/1963 | Noll et al. | 212/298 |
| 4,280,627 A | * | 7/1981 | Becker | 212/198 |
| 5,005,714 A | * | 4/1991 | Kroll et al. | 212/196 |
| 6,089,388 A | * | 7/2000 | Willim | 212/198 |

FOREIGN PATENT DOCUMENTS

| | | | |
|---|---|---|---|
| DE | 73 132 | 5/1970 | B66C/23/42 |
| DE | 26 47 535 | 5/1977 | B66C/23/42 |
| DE | 29 08 584 | 10/1992 | B66C/23/36 |
| EP | 0 048 076 | 6/1981 | B66C/23/42 |

* cited by examiner

*Primary Examiner*—Thomas J. Brahan
(74) *Attorney, Agent, or Firm*—Cohen, Pontani, Lieberman & Pavane

(57) ABSTRACT

The invention relates to a mobile harbor crane for normal and heavy load operation, having an undercarriage and a superstructure mounted thereon. A tower is fastened on the superstructure and a jib which pivotable about a horizontal axis is arranged on a front side of the tower. During a normal mode of operation, the jib is held pivotably on the superstructure by a luffing cylinder coupled to the jib and to the tower and the load lifted and lowered via a hoisting cable guided to the jib head and having a snatch block suspended on it. For a heavy load operating load, the mobile harbor crane further includes a heavy load lifting winch with a heavy load lifting cable which is guided over a deflecting roller fastened to the jib and further guided to a roller assembly of a heavy load snatch block arranged releasably on the jib head. During the heavy load mode of operation, the normal load lifting mechanism of the harbor crane is used as a luffing mechanism for the jib, for which purpose the normal load hoisting cables are detached from the normal load snatch block and fixed to the jib head. In the heavy load mode of operation, the unloaded luffing cylinder is a fall-back support for the jib. The mobile harbor crane further includes an increased righting moment for the heavy load mode of operation.

5 Claims, 3 Drawing Sheets

MOBILE HARBOR CRANE FOR NORMAL AND HEAVY LOAD OPERATION

BACKGROUND OF THE INVENTION

1. Field of the Invention

The present invention relates to a harbor crane for normal and heavy load operation having an undercarriage, a superstructure mounted on the undercarriage, a tower fastened on the superstructure, and a jib arranged on the tower for pivoting about a horizontal axis, the jib in normal operation being held pivotably on the superstructure by a luffing cylinder coupled to the jib and to the tower, wherein the load is liftable by a hoisting cable guided to the jib head and having a snatch block suspended on it.

2. Description of the Related Art

Mobile harbor cranes are frequently also designed for use in heavy load operations. For this purpose, the structural measures necessary for lifting these heavy loads must be provided. The additional structural measures may comprise, for example, relatively strong hoisting mechanisms which can be reversed, relatively strong cables and classification matched to the heavy load to be lifted. Depending on the size of the equipment, normal mobile harbor cranes are able to handle heavy loads of up to 120 t. The ratio of normal load to heavy load is approximately 1:2.

If a load needs to be handled that is greater than the capacity of the crane, two mobile harbor cranes are used in a tandem operation. However, tandem operation requires careful planning and preparation and time-consuming implementation because the coordination of the two mobile harbor cranes is not without risk. Another option for the harbor operator is to use a floating or truck-mounted crane having an appropriately high load-bearing capacity. However, this considerably increases the cost of handling the load and depends on the availability of cranes which can be hired.

SUMMARY OF THE INVENTION

The object of the present invention is to refit a conventional mobile harbor crane with accessory equipment such that the crane is usable in both a normal mode of operation and in heavy load mode of operation with justifiable structural measures and with short setting-up times.

The object the present invention is met by a harbor crane having conventional components including a superstructure, a tower arranged on the superstructure, a jib pivotably arranged on the tower, a luffing cylinder for luffing the jib, and a hoisting mechanism, and hoisting cable guided from the hoisting mechanism to the head of the jib for lifting a load. According to the invention, additional components are fitted on the harbor crane for a heavy load operating mode including a heavy load lifting winch fixed to the superstructure of the harbor crane, preferably below the jib. A heavy load lifting cable is guided from the heavy load lifting winch over a deflecting roller fastened to the jib and guided to the roller assembly of a heavy load snatch block arranged releasably on the jib head. The normal load lifting mechanism of the harbor crane is used in heavy load operating mode as a luffing mechanism for the jib, for which purpose the normal load hoisting cables are detached from the normal load snatch block and fixed to the jib head. During the heavy load operating mode, the unloaded luffing cylinder serves as a fall-back support for the jib. Furthermore, the righting moment of the mobile harbor crane is increased during heavy load operating mode as compared with normal load operating mode.

The components of the harbor crane which are subjected to increased stress because of the additional heavy load equipment such as, for example, the jib, tower, rotary connection and crane support, and their connection constructions are reinforced as required, i.e. only when there is a corresponding increase in carrying load.

A harbor crane having the above-described equipment for heavy-load operation avoids the problems of the prior art. The function and basic structure of a conventional mobile harbor crane are not affected by the additional equipment. The luffing mechanism used during heavy load operation is the hoisting mechanism of the mobile harbor crane so that the piston-cylinder unit of the luffing cylinder is unloaded during heavy load operation. At the same time, the luffing cylinder provided for normal operation serves in heavy load operation as a fall-back support for the jib.

In addition, for heavy load operation a further hoisting mechanism comprising a heavy load lifting winch is provided for lifting the heavy loads. To lift heavy loads securely, the righting moment which is configured for normal load operation of the mobile harbor crane should be increased.

In a further embodiment of the present invention, the righting moment of the mobile harbor crane in heavy load operation may be increased by extending a counter jib which is coupled to the tower on the side opposite the jib away from the tower in a vertical jib pivoting plane. The pivoting of the counter jib may be effected by a pivoting cylinder which also acts as a fall-back support Furthermore, the inclination of the counter jib may be changed via a bracing means fixed in a length-changeable manner at one end to the jib head and at the other end in the foot region of the tower. A head end of the counter jib is arranged for accommodating a supporting device for an additional heavy load counterweight which can be suspended in the vicinity of the ground and whose range of swing can be set by changing the inclination of the counter jib.

In this embodiment of the present invention, the righting moment of the mobile harbor crane is increased. The counter jib, which remains on the apparatus during normal load operation, is extended rearward by a pivoting cylinder and guides and supports the additional heavy load counterweight which is suspended at the head end of the counter jib at the required operative radius. By adjusting the inclination of the counter jib, the range of swing and therefore the counterweight moment may be varied without any problem within a tolerance range.

In a further embodiment of the present invention, the bracing means for changing the inclination of the counter jib comprises bracing rods which are fixed to the jib head. The free ends of the bracing rods may be coupled to deflecting rollers for a respective cable which in heavy load operation is fastened to the counter jib head and is guided via a deflecting roller arranged on the counter jib head to a setting mechanism (winch) arranged on the tower. This solution enables the inclination of the counter jib to be adjusted via the setting mechanism, generally a winch, by the cable being hauled in or made slack.

It is particularly favorable if during normal operation of the harbor crane, the bracing rods are fixed to the jib head are placed on the jib and attached there, and the deflecting rollers detached from their free ends are in each case fastened, with reeved cable, to the head of the tower, each cable being set in the manner prescribed by the counter jib in its upright inoperative position locked by the pivoting cylinder, and the supporting device for the suspended heavy load counterweight being attached to the superstructure. That is, all of the essential parts of the accessory equipment for increasing the carrying load of the mobile harbor crane remain on the vehicle and therefore refitting from normal operation to heavy load operation occurs very rapidly. In particular, the cables largely remained reeved, rendering complicated threading work unnecessary. Further, the heavy load snatch block is temporarily stored in the vicinity of the heavy load hoisting mechanism on the superstructure of the harbor crane during the normal operation of the harbor crane with the heavy load hoisting cable reeved. In practice, the jib is lowered and the heavy load snatch block may be picked up by a forklift truck and with the cable reeved transported to a holding device which is provided on the superstructure of the mobile harbor crane. While the heavy load snatch block is being moved, the hoisting cable is wound up by the heavy load hoisting mechanism without leaving the roller assembly. The hoisting cable is removed only from the guide roller additionally provided on the jib, otherwise all of the cables remain reeved when changing from the heavy load operating mode to the normal operating mode.

To further reduce the setting-up times of the mobile harbor crane, the heavy load counterweight may be designed so that it can be moved, for example on a transport truck which can very easily be transported to the location of use where the supporting device of the counter jib picks up the heavy load counterweight.

The accessory equipment according to the present invention comprises a particularly cost-effective supplement to an existing mobile harbor crane. The re-equipping of a conventional crane to form the heavy load crane is possible within the shortest time and with the lowest outlay because to a large extent all of the parts required for this purpose are provided or are mounted on the mobile harbor crane. The operator of the mobile harbor crane does not have to hire firms offering truck-mounted or deck cranes to move heavy loads. Instead, the operator can himself adapt his equipment within the shortest time to the heavy load requirements.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
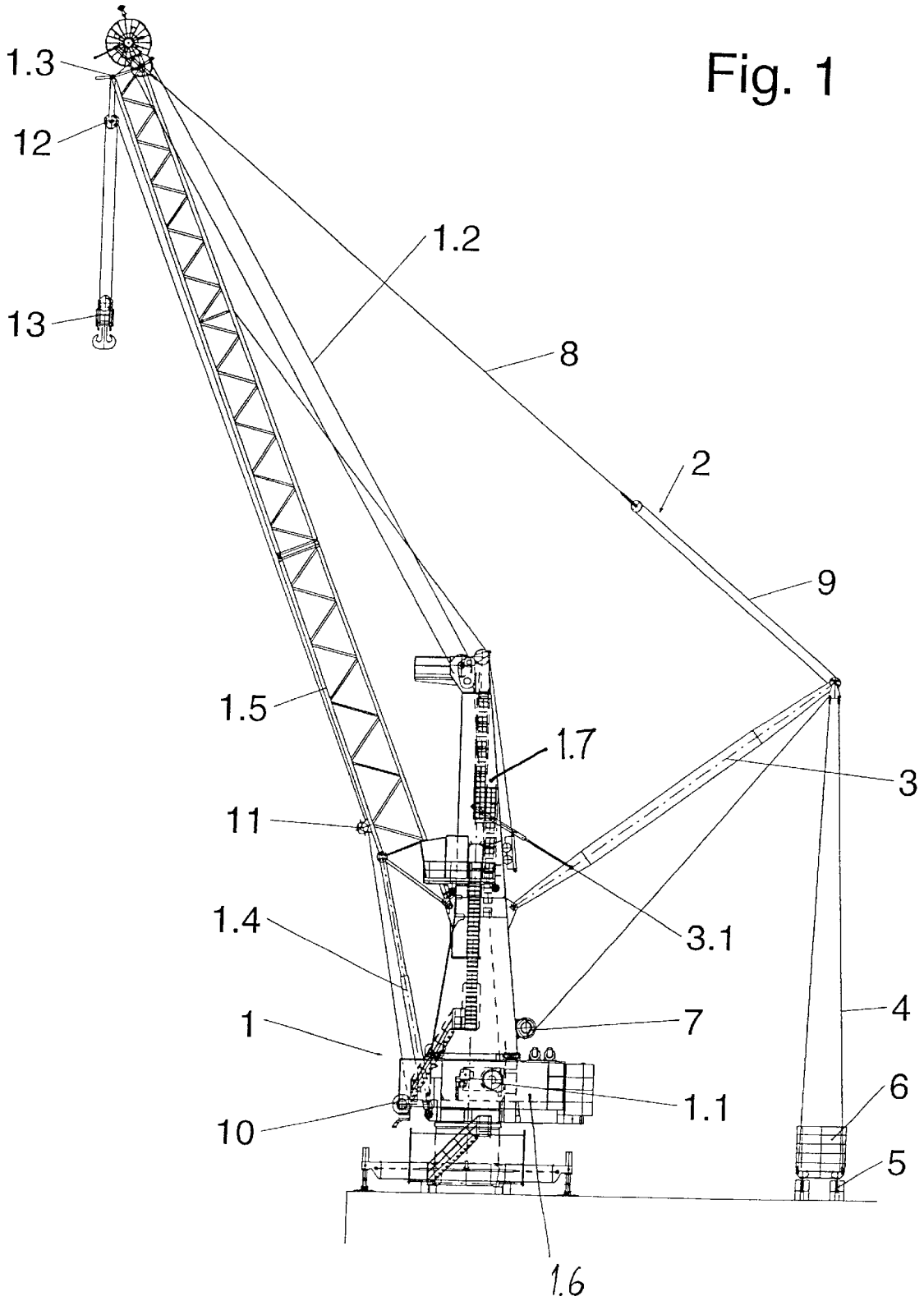
FIG. 1 is a side view of the mobile harbor crane with heavy load equipment according to an embodiment of the present invention in the heavy load operating position.

A conventional mobile harbor crane 1 is illustrated in FIG. 1 with heavy load equipment according to the present invention. The additional equipment 2 for increasing the carrying force includes a counter jib 3 and a pivoting cylinder 3.1 for the counter jib 3, supporting cables 4, a counterweight truck 5, a heavy load counterweight 6, a setting winch 7, bracing rods 8, a setting mechanism 9, a heavy load hoisting mechanism 10, a deflecting roller 11, a roller assembly 12 and a heavy load snatch block 13. The heavy load hoisting mechanism 10 is fastened to a superstructure 1.6 of the mobile harbor crane 1. The hoisting cable is guided from the heavy load hoisting mechanism 10 over the deflecting roller 11 to a head 1.3 of a jib 1.5 of the conventional harbor crane 1 where it is conducted over the roller assembly 12 to the heavy load snatch block 13. The heavy load snatch block 13 may be raised and lowered by actuating the heavy load hoisting mechanism 10.

During the heavy load operating mode, a normal hoisting mechanism 1.1 of the mobile harbor crane 1 is used as the luffing mechanism for the jib 1.5. For this purpose, a hoisting cable 1.2 is guided through a tower 1.7 of the harbor crane 1 (illustrated by dash-dotted lines) over deflecting rollers at the tip of the tower 1.7 (the deflecting rollers are not designated in greater detail) to the jib head 1.3 where the hoisting cable or cables 1.2 are securely fixed. The jib may then be luffed by actuating the normal hoisting mechanism 1.1. The hydraulic luffing cylinder 1.4 is unloaded during the heavy load operation and serves as a fall-back support for the jib 1.5.

The additional transverse loads to which the crane is subjected during the heavy load operating mode are compensated for by the heavy load counterweight 6. This heavy load counterweight 6 is movable via the counterweight truck 5 so that it is positioned below the head of the counter jib 3. A foot of the counter jib 3 is fastened to the tower 1.7 of the mobile harbor crane 1 and is extended to the rear of the tower, counter to the extension of the jib 1.5. The position of the counter jib 3 is held by the bracing rods 8 which are fastened to the jib head 1.3 of the jib 1.5 and by the setting mechanism 9. The setting mechanism 9 comprises a cable coupled to the head of the counter jib 3 and reeved over a roller assembly 9.1 coupled to the bracing rods 8 and returned to the head of the counter jib 3 where it is conducted over further deflecting rollers on the counter jib 3 to the setting winch 7 where it can be rolled up and unrolled. The rolling up and unrolling of the setting mechanism 9 enable the inclination of the counter jib 3 to be adjusted so that the distance of the heavy load counterweight 6 from the mobile harbor crane may be changed. The counterweight 6 is itself connected in a liftable and lowerable manner via the supporting cables 4 to the head of the counter jib 3, so that by actuating the setting mechanism 9 the counterweight 6 can be raised from the ground so as to deploy its full counterweight load.

Figure 2:
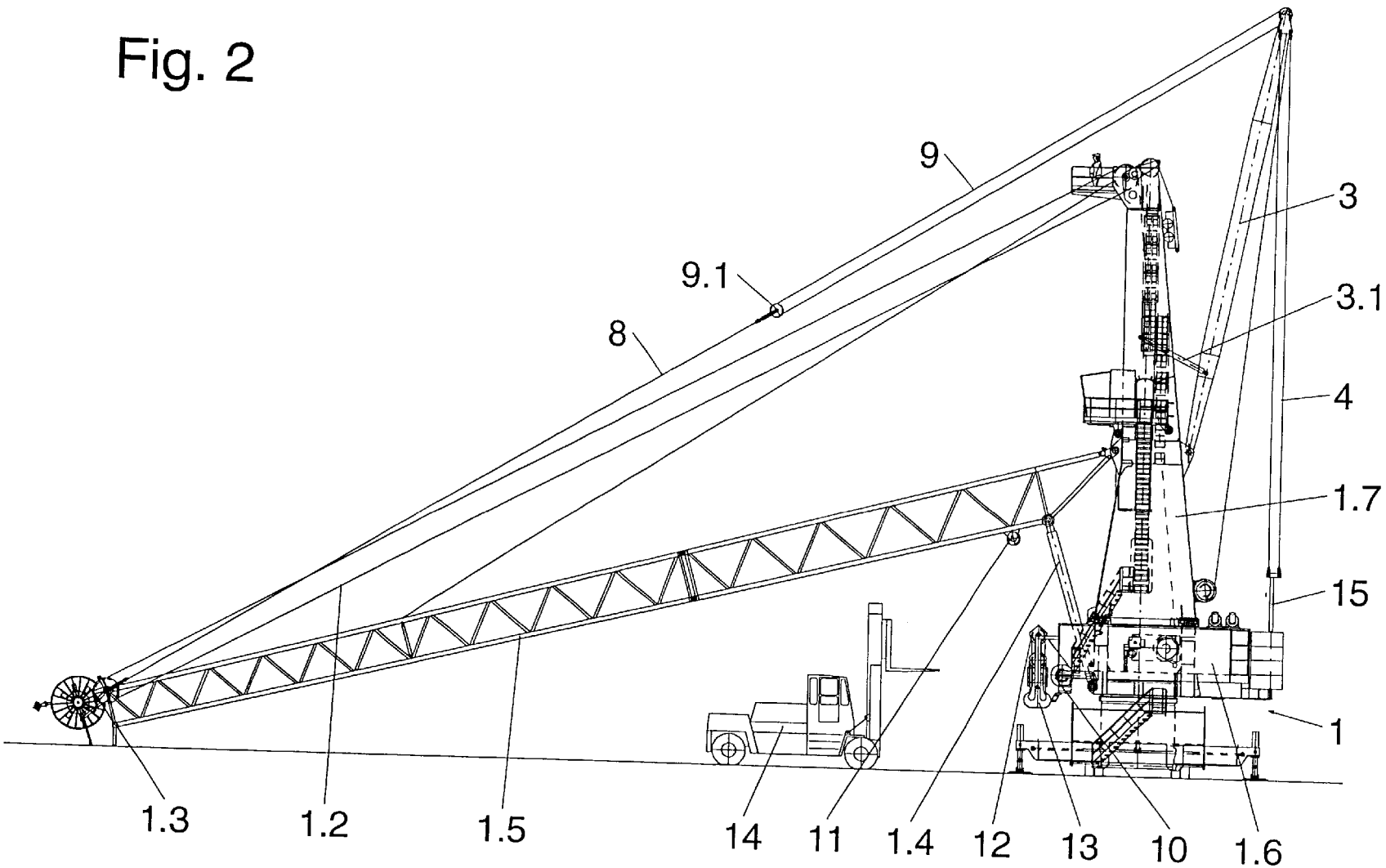
FIG. 2 is a side view of the harbor crane of FIG. 1 in a state of removing the heavy load equipment from the mobile harbor crane.

FIG. 2 illustrates the mobile harbor crane 1 during the process of changing from a heavy load operating mode to a normal operating mode. The jib 1.5 has been lowered so that it is supported on the ground. The cable of the heavy load hoisting winch 10 is unreeved from the deflecting roller 11 on the jib 1.5. The roller assembly 12 and the heavy load snatch block 13 are transported by a forklift truck 14 and stored in an appropriate storage area on the superstructure 1.6. The counter jib 3 is situated in a steep position and is locked by the pivoting cylinder 3.1. The supporting cables 4 are fastened to a framework 15 situated on the superstructure 1.6. The ends of the two hoisting cables 1.2 are detached at the jib head 1.3 and refitted to the means for picking up a load for normal operation 1.8 (see FIG. 3). The luffing cylinder 1.4 is again connected as the luffing mechanism for lifting the jib 1.5. At the same time, the setting mechanism 9 is retracted via the setting winch 7 and the roller assembly 9.1 is deposited on the tip of the tower 1.7. The bracing rods 8 are detached from the roller assembly and deposited and locked to the jib 1.5, which in the meantime may be set up steeply by the luffing cylinder 1.4.

Figure 3:
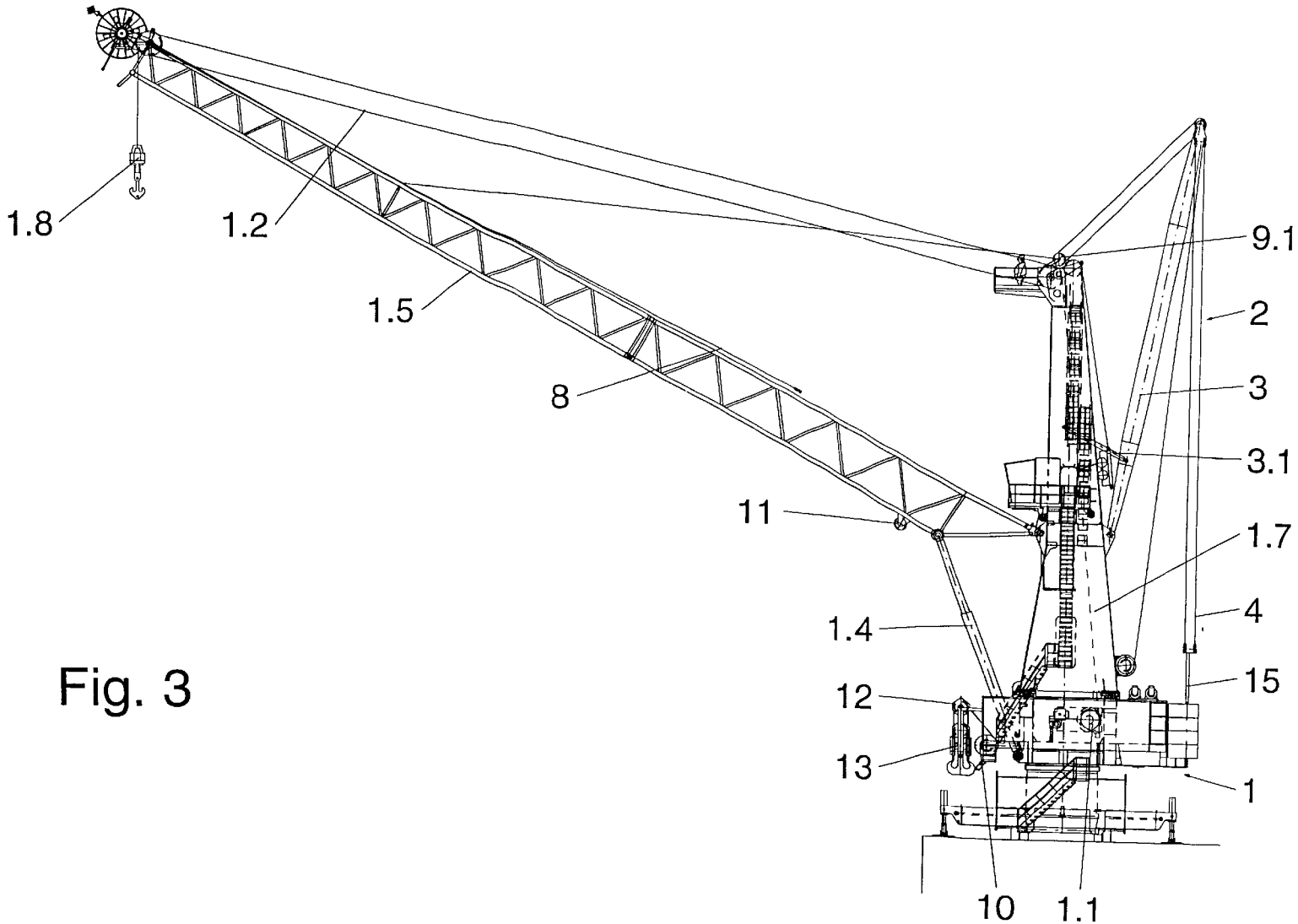
FIG. 3 is a side view of the harbor crane of FIG. 1 in the normal operating position.

FIG. 3 shows the mobile harbor crane 1 in its stripped down normal operating mode. The additional equipment 2 of the invention is inoperative. The counter jib 3 is pivoted upward and locked, the supporting cables 4 are fastened to the framework 15. The bracing rods 8 lie on the jib 1.5 and the roller assembly 9.1 on the tower 1.7 in an inoperative position. The roller assembly 12 and the heavy load snatch block 13 are mounted in front of the heavy load hoisting winch 10 on the superstructure 1.6. Furthermore, the heavy load hoisting cable is reeved. The hoisting mechanism 1.1 of the mobile harbor crane again operates in normal operation, for this purpose the ends of the two hoisting cables 1.2 are fitted to the means for picking up a load 1.8. The pivoting of the jib 1.5 is now controlled via the luffing mechanism and the luffing cylinder 1.4.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A mobile harbor crane for normal and heavy load operation, comprising:

an undercarriage with a superstructure rotatably mounted thereon;

a tower arranged on said superstructure and a jib pivotally connected to a front side of said tower for pivoting about a substantially horizontal axis;

a luffing cylinder coupled between said jib and said tower for holding and pivoting said jib during a normal operating mode;

a normal load lifting mechanism comprising a normal load hoisting cable with a normal load snatch block suspended therefrom for picking up a load during said normal operating mode;

a heavy load lifting winch arranged on said superstructure and comprising a heavy load lifting cable;

a deflecting roller and a heavy load snatch block having a roller assembly arranged on said jib so that said heavy load lifting cable is guidable over said deflecting roller and to said roller assembly of said heavy load snatch block for lifting loads during a heavy load operating mode, wherein said normal load hoisting cables are detachable from said normal load snatch block and fixable to a head of said jib such that said normal load lifting mechanism is arrangeable as a luffing mechanism for said jib during said heavy load operating mode, said luffing cylinder being unloaded during said heavy operating mode and serving as a fall-back support for said jib; and means for increasing a righting moment of said mobile harbor crane during said heavy load operating mode, wherein said means for increasing a righting moment comprises a counter jib pivotally coupled to a rear side of said tower opposing said front side on which said jib is pivotally connected, a pivoting cylinder operatively arranged between said tower and said counter jib for pivoting said counter jib in a vertical jib pivoting plane, said pivoting cylinder further comprising a fall-back support for said counter jib, a bracing means having one end fixed to said head of said jib and another end at a foot end of said tower, said bracing means being further connected to said counter jib for changing an inclination of said counter jib via a change in a length of said bracing means, and a supporting device comprising a heavy load counterweight suspended from said counter jib and arranged in vicinity of the ground, wherein a range of swing of said supporting device is settable via a change in inclination of said counter jib.

2. The mobile harbor crane of claim 1, wherein said bracing means comprises bracing rods having one end fixed to said head of said jib head and free ends coupleable to a roller assembly connected to a bracing cable arranged on said counter jib during said heavy load operating mode, and a setting mechanism arranged on said tower for guiding an inclination of said counter jib via a deflecting roller arranged on a head of said counter jib.

3. The mobile harbor crane of 2, wherein said bracing rods are attachable to said jib during said normal operating mode, each roller assembly being detachable from said free bracing ends of said bracing rods and connectable to a head of said tower, each cable reeved on said roller assembly being connected to said counter jib arranged in an upright inoperative position and locked by said pivoting cylinder, and said supporting device for said suspended counterweight being attachable to said superstructure during said normal operating mode.

4. The mobile harbor crane claim 1, wherein said heavy load hoisting cable is reeved onto said heavy load lift winch and said heavy load snatch block is storable proximate said heavy load lifting winch on said superstructure of said mobile harbor crane during said normal operating mode.

5. The mobile harbor crane of claim 1, wherein said heavy load counterweight is movable.

* * * * *